US011390064B2

(12) United States Patent
Bauer et al.

(10) Patent No.: US 11,390,064 B2
(45) Date of Patent: Jul. 19, 2022

(54) PRINTING PRESS AND METHOD FOR PRODUCING SECURITY PRODUCTS OR SECURITY INTERMEDIATE PRODUCTS

(71) Applicant: KOENIG & BAUER AG, Würzburg (DE)

(72) Inventors: Stefan Bauer, Thüngersheim (DE); Thomas Kersten, Chernex (CH); Patrick Kress, Bad Mergentheim-Edelfingen (DE); Johannes Schaede, Würzburg (DE); Volkmar Schwitzky, Würzburg (DE); Thomas Türke, Lonay (CH); Daniel Ziegler, Hammelburg (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/294,704

(22) PCT Filed: Nov. 27, 2019

(86) PCT No.: PCT/EP2019/082734
§ 371 (c)(1),
(2) Date: May 18, 2021

(87) PCT Pub. No.: WO2020/114857
PCT Pub. Date: Jun. 11, 2020

(65) Prior Publication Data

US 2021/0362487 A1 Nov. 25, 2021

(30) Foreign Application Priority Data

Dec. 4, 2018 (DE) ..... 10 2018 130 838.8

(51) Int. Cl.
*B41F 11/02* (2006.01)
*B41M 3/14* (2006.01)

(52) U.S. Cl.
CPC ..... *B41F 11/02* (2013.01); *B41M 3/14* (2013.01)

(58) Field of Classification Search
CPC ..... B41F 11/02; B41F 33/0036; B41M 3/14
See application file for complete search history.

(56) References Cited

U.S. PATENT DOCUMENTS 9,533,486 B2 1/2017 Kress et al.
2006/0213384 A1 9/2006 Reinhard et al.
(Continued)

FOREIGN PATENT DOCUMENTS

CN 204249518 U 4/2015
DE 10332212 A1 2/2005
(Continued)

OTHER PUBLICATIONS

International Search Report of PCT/EP2019/082734 dated Feb. 26, 2020.

*Primary Examiner* — Leslie J Evanisko
*Assistant Examiner* — Leo T Hinze
(74) *Attorney, Agent, or Firm* — Mattingly & Malur, PC

(57) ABSTRACT

A printing press and a method for producing security products or security intermediate products comprises a feed device for feeding unprinted printing substrate into the printing press. Multiple printing couples print the unprinted printing substrate in an indirect planographic or in a letterpress printing method in one or more printing nips. In a conveyor line, between the feed device and the first printing nip located in the printing substrate path, at least one inspection device, which is embodied as a transmissive inspection device, is provided for inspecting the as yet unprinted printing substrate.

13 Claims, 9 Drawing Sheets

(56) References Cited

U.S. PATENT DOCUMENTS

| | | | | |
|---|---|---|---|---|
| 2008/0066638 | A1* | 3/2008 | Salgari | B41F 33/0045 101/484 |
| 2009/0003656 | A1* | 1/2009 | Reinhard | G07D 7/12 382/112 |
| 2016/0221325 | A1 | 8/2016 | Kress et al. | |
| 2017/0008271 | A1* | 1/2017 | Schaede | B41F 31/00 |
| 2017/0326870 | A1* | 11/2017 | Schaede | B41F 7/06 |
| 2021/0086498 | A1 | 3/2021 | Bauer et al. | |

FOREIGN PATENT DOCUMENTS

| | | | |
|---|---|---|---|
| EP | 1980393 | A1 | 10/2008 |
| EP | 2484523 | A1 | 8/2012 |
| WO | 2012059861 | A1 | 5/2012 |
| WO | 2015/032515 | A1 | 3/2015 |
| WO | 2015/118447 | A2 | 8/2015 |
| WO | 2016/071870 | A1 | 5/2016 |
| WO | 2020/052935 | A1 | 3/2020 |

* cited by examiner

PRINTING PRESS AND METHOD FOR PRODUCING SECURITY PRODUCTS OR SECURITY INTERMEDIATE PRODUCTS

CROSS-REFERENCE TO RELATED APPLICATIONS

This application is the US national phase, under 35 USC § 371, of PCT/EP2019/082734, filed Nov. 27, 2019; published as WO 2020/114857 A1 on Jun. 11, 2020, and claiming priority to DE 10 2018 130 838.8, filed Dec. 4, 2018, the disclosures of which are expressly incorporated herein in their entireties by reference.

FIELD OF THE INVENTION

The present invention relates to a printing press, in particular a security printing press, and to a method for producing security products or security intermediate products. The printing press for producing the security products or the security immediate products comprises a feed device for feeding unprinted printing substrate into the printing press. Multiple printing couples are provided, by which the unprinted printing substrate can be printed in an indirect planographic or in a letterpress printing method in one or more printing nips. In a method for producing the security products or the security intermediate product, using a printing press according to the present invention, an as yet unprinted printing substrate is fed into the input side of a printing press, in particular, a security printing press. The printing substrate is printed on one or both sides in an indirect planographic printing method or in a letterpress printing method in a printing nip, lying in the printing substrate path.

From WO 2016/071870 A1 a printing press is known, by means of which sheet-format substrate guided along a transport path can be printed in a multicolor perfecting printing process in two printing nips in succession, which are spaced apart from one another in the transport path. Multicolor printing is carried out in said press by means of a collect printing couple, such that the partial print images of multiple forme cylinders are collected on an ink collecting cylinder, and are then transferred collectively in the printing nip to the substrate.

EP 1 980 393 A1 relates to a method and a system for producing security documents, for example, in which offset printing, screen printing, numbering printing, and varnishing, among other steps, are carried out in multiple processes in succession.

DE 103 32 212 A1 relates to a security printing press comprising a numbering printing unit for numbering the banknote copies printed on the sheet, or at least one marking device, by means of which sheets that are identified as defective can be identified as such. Upstream of the numbering and/or marking steps, a first and a second inspection device, which have an image sensor and a light source, are provided for inspecting the front and back sides. A further inspection device may also be provided, which comprises an image sensor and a transmitted light source for transmitting light through the sheets to be inspected, and which enables, e.g. inspections of watermarks or of the correct registration of prints on the front and back sides of the sheets in relation to one another. WO 2012/059861 A1 discloses an inspection device, in one embodiment of which one transmissive inspection and two reflective inspections are carried out in succession. The proposed solution involves the use of a light-emitting organic surface on the transport cylinder used for transmissive inspection. In an example for use in a printing press, such a light-emitting organic surface is provided on the path to the delivery unit, to allow the sheets to be inspected before being dropped.

CN 204 249 518 U discloses an offset printing press for security printing, having a dual-sided inspection device for inspecting water marks, holograms, security lines, or pearlescent printing contained in the paper. The inspection devices comprise infrared cameras positioned opposite one another along the transport path.

WO 2015/118447 A2 relates to a letterpress printing press, in particular a numbering printing press, and is directed toward a specific solution for a printing group, in which two numbering cylinders cooperating directly with an impression cylinder receive ink from the same ink-collecting cylinder. In a further refinement, it is possible for the printing group to be combined with an inspection device positioned upstream. Such an inspection device can comprise incident light inspection on the front and back sides and a transmitted light inspection.

EP 2 484 523 A1 discloses a printing press having an offset printing unit for printing a ground tint pattern. Between the sheet feed device and the offset printing unit, a first inspection unit having a first and a second camera for inspecting sheet quality is provided, which is directed toward the front or back side of the sheets being conveyed over respective transfer cylinders and comprises an infrared camera and a color camera for capturing images of watermarks, holograms, "pearl print", or "security wire". A second inspection unit for inspecting sheet quality is also provided, having a first camera directed toward one side of a sheet directed over a transfer cylinder and a second camera directed toward the other side of a sheet directed over a transfer cylinder, each of which comprises an ultraviolet camera for capturing images of security fibers contained in the printing substrate.

WO 2020/052935 A1 discloses, in one of its variants, a reflective and transmissive device in a transfer unit configured as an inspection unit; such a transfer unit may be provided between processing units, downstream of the last processing unit or between the substrate infeed and the subsequent first processing unit.

SUMMARY OF THE INVENTION

The object of the present invention is to provide a printing press and a method for producing security products or security intermediate products.

The object is attained according to the invention by the provision, in a conveyor line between the feed device and the first printing nip located in the printing substrate path, of at least one inspection device which is embodied as a transmissive inspection device which is provided for inspecting the as yet unprinted printing substrate. Before the unprinted printing substrate reaches the printing nip, it is inspected in a transmitted light method by at least one inspection device, embodied as a transmissive inspection device, for security features that are already contained in the as yet, unprinted printing substrate.

The advantages to be achieved with the invention consist, in particular, in that the risk of producing defective copies of securities is reduced. This advantage is produced by enabling defective sections or sheets of printing substrate to be identified and removed even prior to the first printing step. Security features that are contained in the unprinted security printing substrate are easier to detect in the as yet unprinted state than after a first printing in a first printing process, in which the printing substrate is furnished with a background pattern or a background color gradient, e.g. with high area coverage.

For this purpose, at least one inspection device is positioned upstream of a first printing nip of a preferably first printing process. A transmissive inspection device operating according to the transmitted light method is preferably provided in this case, by means of which the as yet unprinted printing substrate is or can be inspected for security features contained in or on the printing substrate. IR radiation is used for this purpose.

According to the invention, a reflective inspection device is provided, likewise upstream of the first printing nip or upstream of the initial printing step, by means of which the as yet unprinted printing substrate is or can be inspected for security features contained in or on the printing substrate. UV radiation is used for this purpose. The as yet unprinted printing substrate in this context is, in particular, one that is completely unprinted, i.e. printing substrate that has not been printed even in a previous process.

Of particular advantage is an embodiment in which a transmissive inspection device and a reflective inspection device are provided along the transport path of the same transport cylinder.

A printing press that is suitable for implementing the invention, in particular a security printing press for producing security products or security intermediate products, comprises a feed device for feeding unprinted printing substrate into the printing press, multiple printing couples by which the unprinted printing substrate can be printed on both sides in one or more printing nips in a single-color or a multicolor process, preferably by an indirect planographic or letterpress printing method and/or by a collect printing method, with the print images from multiple forme cylinders simultaneously, two inspection devices for inspecting the as yet unprinted printing substrate being provided in a conveyance path between the feed device and the first printing nip in the printing substrate path. Downstream of the at least one printing nip, a product delivery is provided in the printing substrate path, for example, by means of which the printed printing substrate in the form of security products or security intermediate products can be collected to form bundles.

In the production of security products or security intermediate products, an as yet unprinted printing substrate is fed in on the input side, e.g. for printing of the background, the printing substrate is printed for the first time, on one or on both sides, in a first printing process in a first printing nip in the printing substrate path, and downstream of the printing step is collected into bundles in a product delivery, wherein before the as yet unprinted printing substrate reaches the first printing nip, it is inspected by at least one inspection device for security features that are already contained in the as yet unprinted printing substrate.

Other refinements, which may be added individually or in combinations to the basic concept of the invention, are found in the dependent claims and in the exemplary embodiments.

BRIEF DESCRIPTION OF THE DRAWINGS

Exemplary embodiments of the invention are illustrated in the set of drawings and will be described in greater detail in the following.

The drawings show.

DESCRIPTION OF PREFERRED EMBODIMENTS

Figure 1:
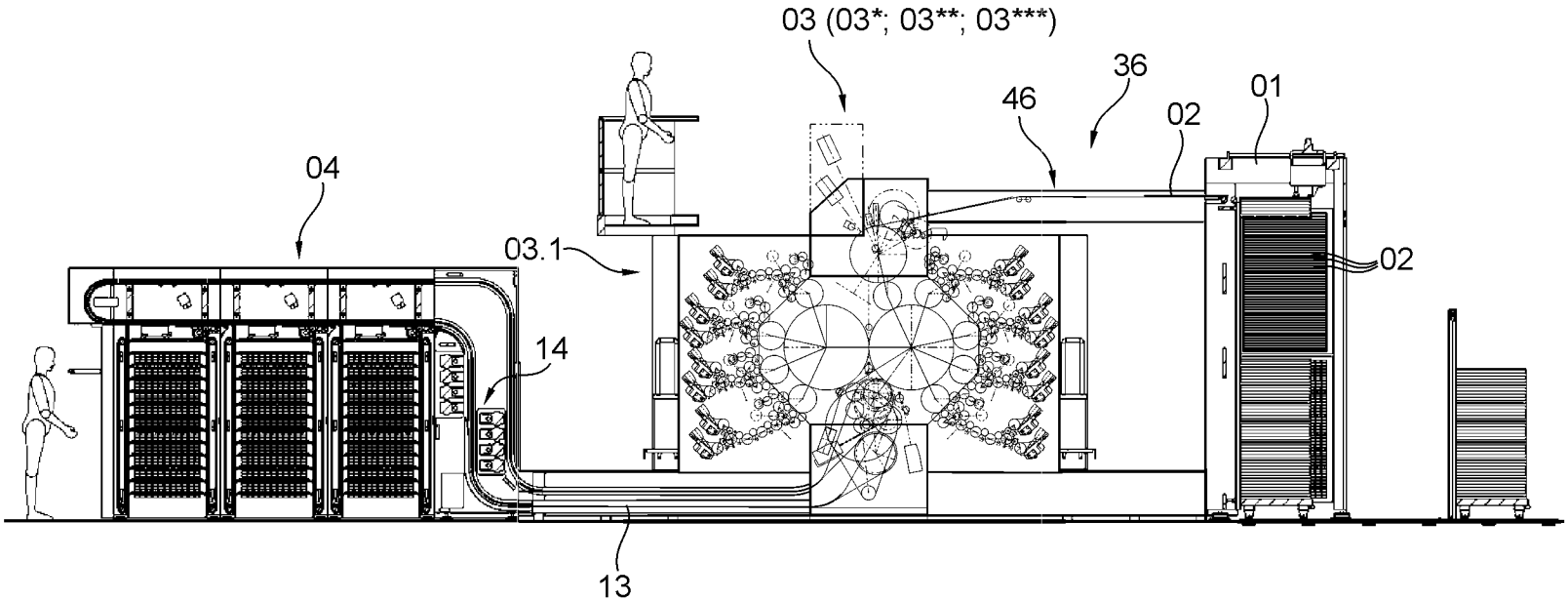
FIG. 1 a first exemplary embodiment of a printing press with one printing group in the first embodiment.
Figure 8:
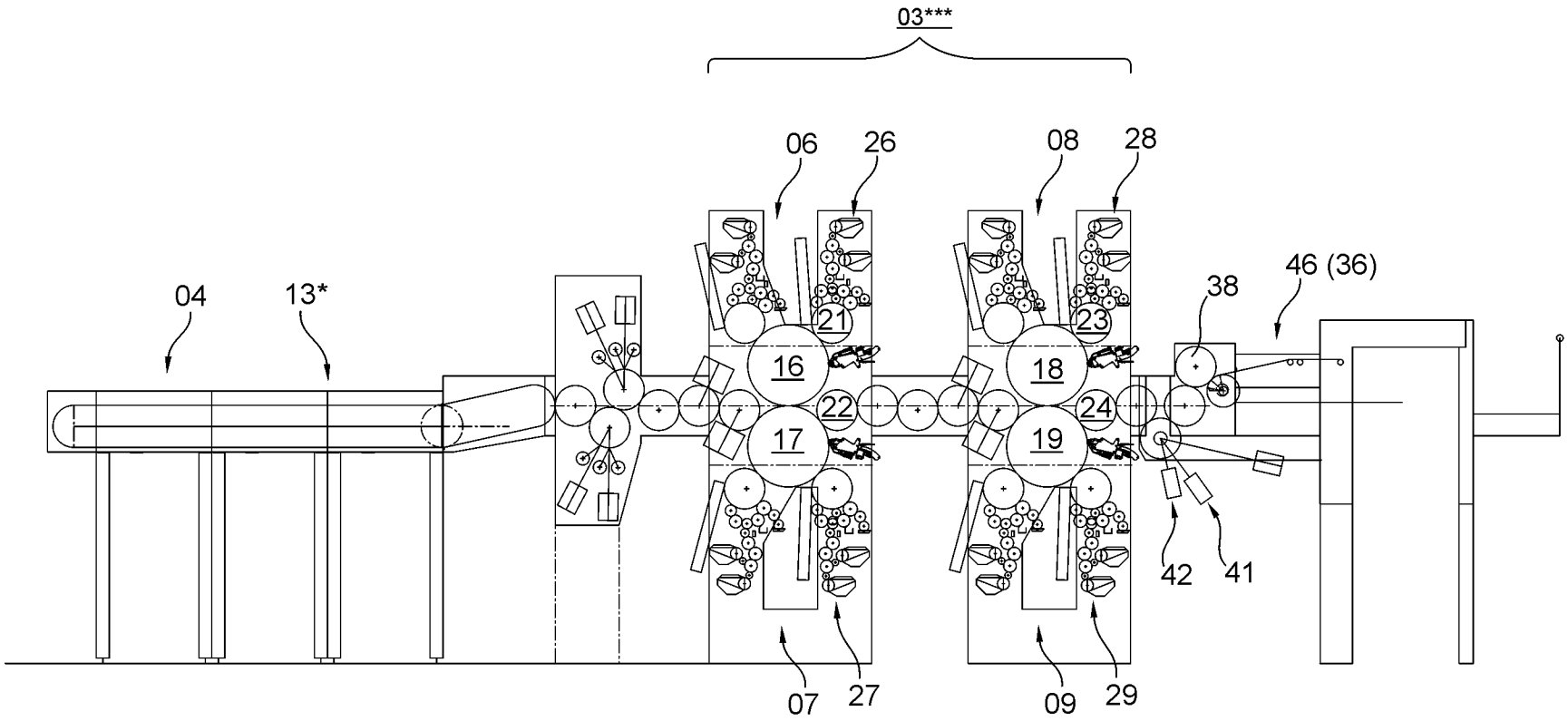
FIG. 8 a second exemplary embodiment of a printing press with one printing group.

A printing press, in particular a printing press for printing onto sheet-format printing substrate 02, comprises on the input side a feed device 01, e.g. a sheet feeder 01 or optionally a roll unwinder with a cross-cutting device downstream, which supplies printing substrate 02 to the printing press on the input side thereof, one or more printing couples 06; 07; 08; 09, by which the sheet-format printing substrate 02, or printing substrate sheet 02 for short, can be or is printed one or more times on one or on both sides in a single-color or multicolor process, and a product delivery 04, e.g. pile delivery 04 or optionally a roll winder, where the printed printing substrate sheets 02 or webs in the form of products or intermediate products are delivered, e.g. are deposited onto a pile or wound onto rolls, to form bundles (see, e.g., FIG. 1 and FIG. 8). In the embodiment preferred here and depicted in the figures, the printing press is embodied as a security printing press and is configured, for example, to produce, in particular, as yet unprinted printing substrate sheets 02, or sheets 02 for short, in particular for the subsequent production of sheets of security documents 02, with a plurality of copies, e.g. print images of individual banknotes, per sheet 02, as products or as intermediate products for further processing. The printing substrate sheets 02 can be delivered downstream onto one or preferably multiple piles in the pile delivery 04. The pile delivery 04 preferably comprises multiple pile spaces, e.g. at least or precisely three pile spaces, one behind the other as viewed in the transport direction, to form a corresponding number of piles; at least one of the pile spaces can be or is used to form a scrap pile. The printing substrate 02 intended and/or suitable for the production of security documents already comprises security features, e.g. security threads, foil applications, security fibers, and/or watermarks, in its as yet unprinted state, for example.

In the process of producing security products or security intermediate products, printing substrate 02, e.g. in the form of printing substrate sheets 02, is printed, for example, multiple times in multiple process steps using various printing methods and is optionally furnished with foil elements or other applications. For example, first the as yet unprinted printing substrate 02 is printed in a first or initial printing process in one or more steps, preferably according to a planographic printing or letterpress printing method, indirect in particular, with, e.g. a single-color or preferably multicolor motif that provides an image background and that covers, for example, a majority of the printing area of the respective copy, i.e. with more than 50%, in particular more than 70% area coverage. This first printing according to the preferably indirect planographic printing and/or letterpress printing method, for example, can be carried out on the same side of the printing substrate all at once in one printing nip 11 or by multiple printing nips 11; 12 in succession.

Preferably, printing is carried out in at least one printing nip 11; 12 in a multicolor collect printing process, i.e. with the simultaneous application of multiple color segments in the same printing nip 11; 12. The initial printing process can be carried out on one side or preferably on both sides.

In the production of security documents, the printing substrate 02 is first printed one or more times in one or more printing nips 11; 12 in a first printing process, e.g. according to an indirect planographic printing or letterpress printing method or according to both of these methods, with the background, for example, after which it is printed in at least one subsequent printing process downstream in the same printing press or in at least one additional printing press on at least one printing substrate side in a printing method that is different from the indirect planographic printing method and the indirect letterpress printing method. In particular, in at least one subsequent printing process carried out downstream in the same printing press or in at least one additional printing press, it is printed with alphanumeric characters in a direct letterpress printing method by at least one numbering printing couple, and/or in a subsequent printing process carried out downstream in the same printing press or in at least one additional printing press, it is printed with an image motif in a gravure printing method, and/or in a subsequent printing process carried out downstream in the same printing press or in at least one additional printing press, it is printed with image elements that occupy, for example, less than half the area coverage on the respective copy, in a screen printing method.

As yet unprinted printing substrate 02 is or should be understood in this context as completely untreated raw materials for printing, such as untreated web-format or sheet-format foil, fiber, or paper materials or hybrid products thereof, but also as printing substrate 02, to the surface of which a fluid, for example a paint or primer, has been applied over the entire surface and/or uniformly in a preceding process step, for example, for the purpose of pretreating or conditioning the printing substrate 02 for the printing process, for example. In contrast to the full-surface and/or uniform coating step, the initial printing in this context is therefore, e.g. the formation of a print image, i.e. of image information formed by varying color intensity and/or colors, by an intentionally uneven and/or structured application of material, in particular a single-color or multicolored application of ink, which is discontinuous over the printable area of the security copy, image information that is detectable by the viewer or by a sensor system and that may contain, e.g., any desired regular or irregular patterns or color gradients, image motifs, alphanumeric characters, or combinations thereof.

If multiple printing couples 06; 07; 08; 09 are provided in the printing substrate path of the printing press that preferably effects the initial printing of the as yet unprinted printing substrate 02, said printing couples can be arranged individually or in groups in multiple separate units 03.1; 03.2; 03;1*; 03.2* along the transport path or all together in one common unit. Generally, two printing couples 06; 07; 08; 09 cooperating in one printing nip 11; 12 that acts as a blanket-to-blanket printing nip 11; 12, two printing couples 06; 07; 08; 09 that print the printing substrate 02 on the same side or on opposite sides of the printing substrate in straight printing nips 11; 12 that are spaced apart from one another in the transport path, one printing couple 08 arranged on one side to form a printing nip 12*, in particular one straight printing nip 12* and, upstream or preferably downstream thereof, two printing couples 06; 07 that form a blanket-to-blanket printing couple 06, 07 or a blanket-to-blanket printing nip 11, or four printing couples 06; 07, 08; 09 that, in pairs, each form one blanket-to-blanket printing couple 06, 07; 08, 09 or one blanket-to-blanket printing nip 11; 12 may be provided. Preferably, at least two printing nips 11; 12 are provided in succession in the transport path, of which at least one, preferably at least the downstream printing nip 11, is embodied as a blanket-to-blanket printing nip 11, or even both printing nips 11; 12 are embodied as blanket-to-blanket printing nips 11; 12. The printing couple 09; 09*; 08 that forms the sole or at least the first printing nip 12; 12*; 11 that acts on at least one side of the printing substrate is preferably configured to operate according to a preferably indirect planographic printing or letterpress printing method.

In the printing substrate path between feed device 01 and product delivery 04, one printing group 03 having only one printing nip 11, or one printing group 03*; 03; 03*** having two or more printing nips 11; 12 in succession downstream may be provided. In the printing press according to FIG. 1, depicted by way of example, at the location where the printing group 03 is shown a different one of the advantageous embodiments for the configuration of the printing group 03; 03*; 03**; 03*** described in the following may be provided. In the printing substrate path between said printing group 03; 03*; 03**; 03*** and the product delivery 04, the printing press can generally also comprise one or more additional processing stages, e.g. an application device and/or a varnishing device and/or an additional printing group that operates according to a printing method that is different from the printing method of the first printing group 03; 03*; 03**; 03*****.

Figure 2:
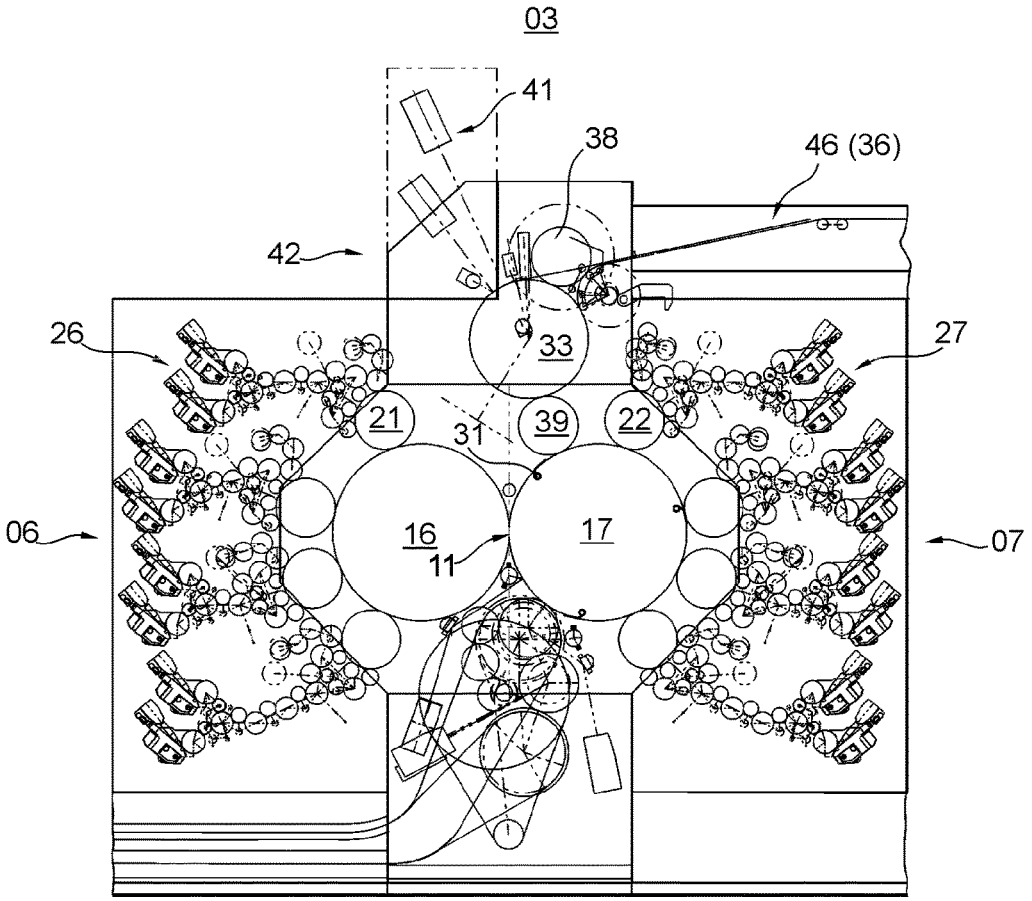
FIG. 2 an enlarged view of the printing group in the first embodiment from FIG. 1.
Figure 3:
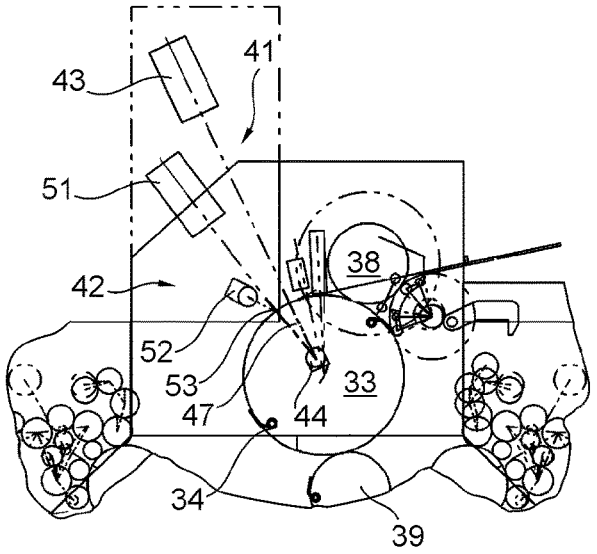
FIG. 3 a section of the conveyor line located upstream of the first printing nip of the printing group in the first embodiment and comprising the inspection devices.

In a first embodiment of the printing press and/or the printing group 03, a blanket-to-blanket printing nip 11, for example, is provided downstream of the feed device 01 as a first, and in this case sole, printing nip 11 in the printing substrate path (see, e.g. FIG. 1 to FIG. 3).

Figure 5:
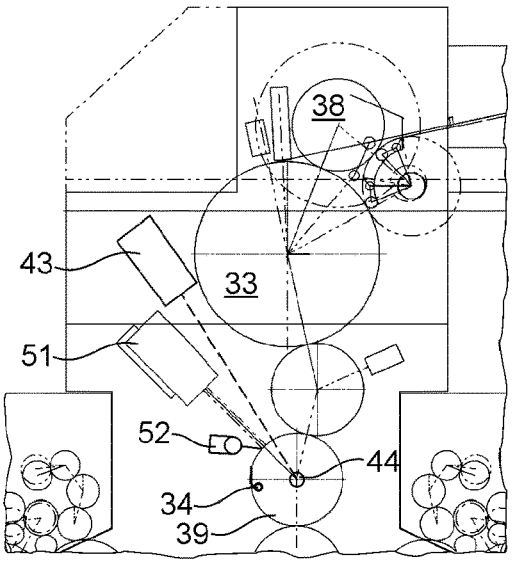
FIG. 5 a section of the conveyor line located upstream of the printing nip of the printing group in the second embodiment and comprising the inspection devices.
Figure 6:
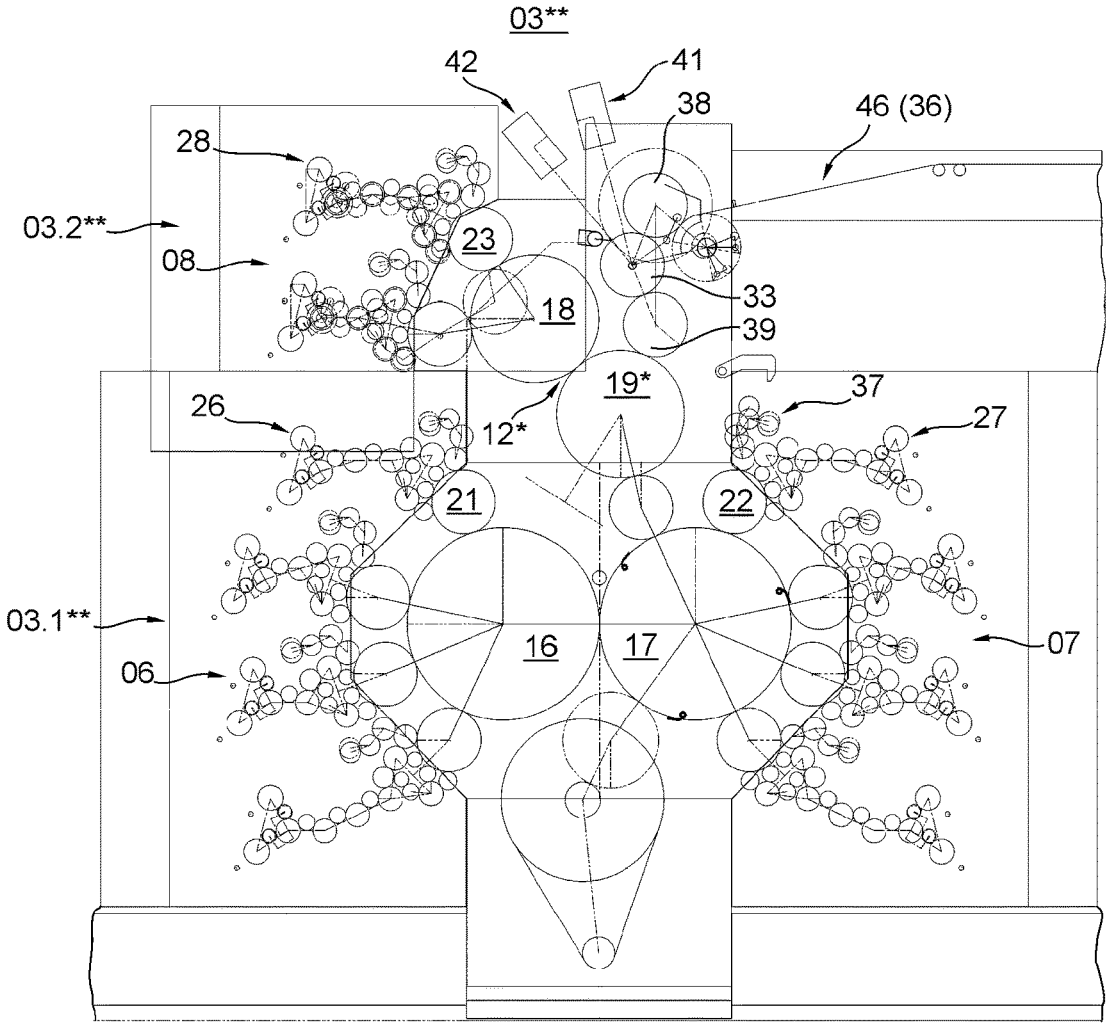
FIG. 6 an enlarged illustration of a printing group in a third embodiment alternative to the first and second embodiments.
Figure 7:
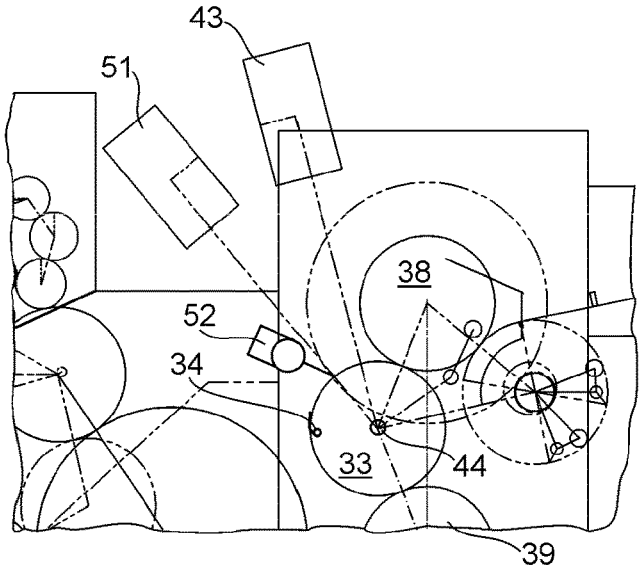
FIG. 7 a section of the conveyor line located upstream of the printing nip of the printing group in the third embodiment and comprising the inspection devices.

In other embodiments (see, e.g. FIG. 4 and FIG. 5, along with FIG. 6 and FIG. 7), in the printing substrate path upstream of a printing nip 11 embodied as a blanket-to-blanket printing nip 11, a printing nip 12; 12* that forms the first printing nip 12; 12* following the feed device 01 in the transport path is provided in the printing substrate path and is likewise embodied, e.g. as a blanket-to-blanket printing nip 12 (see, e.g. FIG. 4 and FIG. 5) or as a straight printing nip 12* (see, e.g. FIG. 6 and FIG. 7).

In second and third embodiments of a printing press presented here as alternatives to the first embodiment, the printing couples 06; 07; 08; 09 of two successive printing nips 11; 12; 12* are provided in one printing group 03*; 03 formed as a printing nip group 03*; 03**, in particular as a printing tower 03*; 03**, e.g. in two stacked units 03.1*; 03.2*; 03.1**; 03.2**, for example, e.g. printing units 03.1*; 03.2*; 03.1**; 03.2****.

The transport path through the at least one printing nip 11; 12; 12* and/or between two printing nips 11; 12; 12* extends vertically, in particular from top to bottom, in the exemplary embodiments according to FIG. 1 to FIG. 7.

Figure 9:
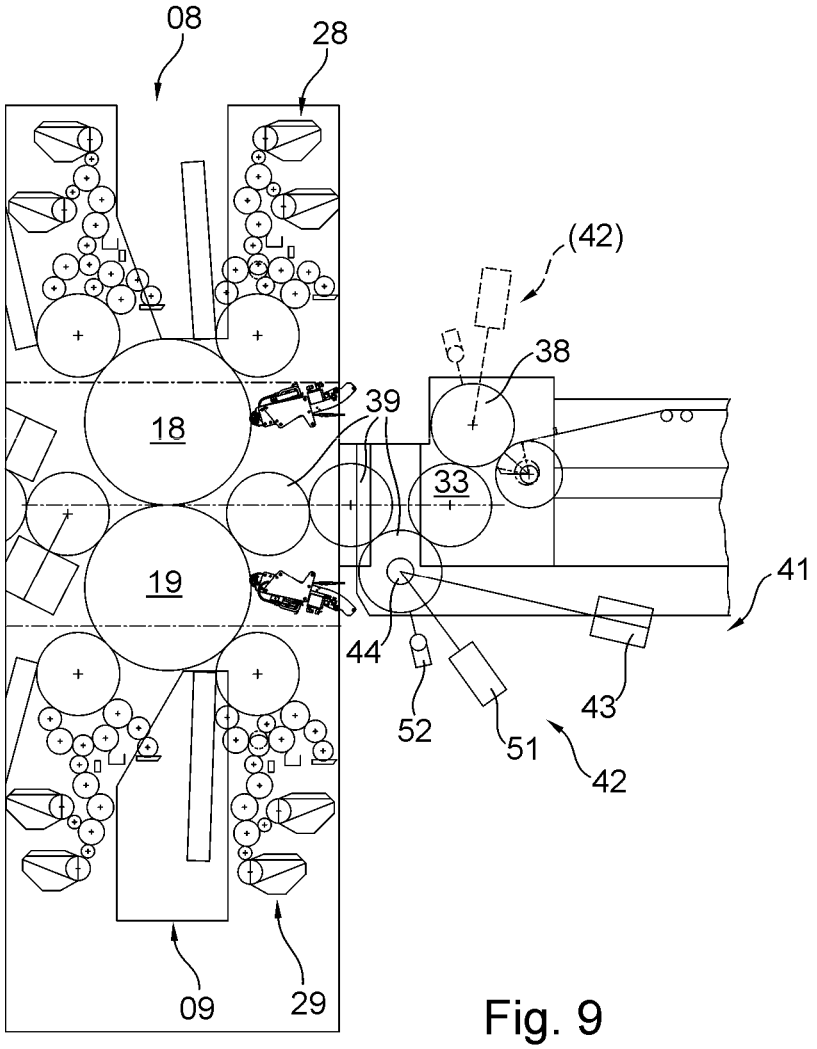
FIG. 9 an enlarged illustration of a printing group from FIG. 8.
Figure 10:
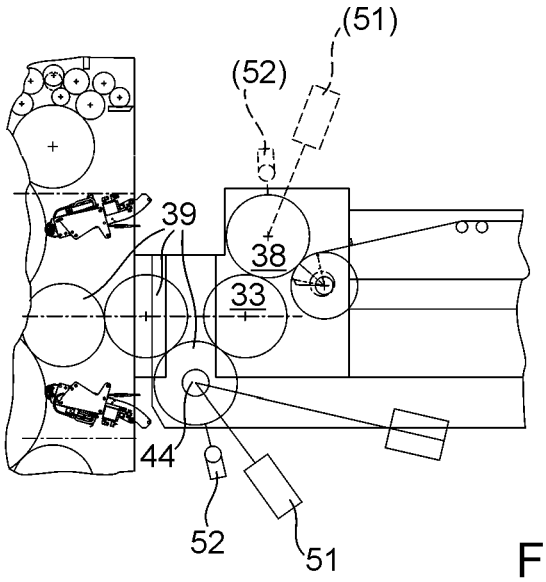
FIG. 10 a section of the conveyor line located upstream of the first printing nip of the printing group from FIG. 8 and FIG. 9 and comprising the inspection devices.

In a second embodiment of a printing press, depicted by way of example, e.g. in FIG. 8 to FIG. 10, the transport path extends horizontally through at least one and/or between two printing nips 11; 12. For a printing nip 11; 12 configured as a blanket-to-blanket printing nip 11; 12, the printing couples 06; 07; 08; 09 that form the printing nip 11; 12 are then arranged one above the other. The information corresponding to the examples involving a vertical printing substrate path apply to the configuration of the printing couples 06; 07; 08; 09, with the 45° rotation of the assembly and the optionally different number of forme cylinders 21; 22; 23; 24.

A "vertical" transport path is understood in this context as a printing substrate path that, in the section of the path in question, e.g. between the intake and output of a printing unit or a printing group or between two printing nips, covers a greater distance in the vertical direction than in the horizontal direction. For the "horizontal" transport path, the reverse is true.

In general, the printing couples 06; 07; 08; 09 of printing nips 11; 12 that are spaced apart from one another can be configured on the basis of different printing methods. At least the printing couple 06; 07; 08; 09; 09* or printing couples 06; 07; 08; 09; 09* involved in the sole or first printing nip 12; 11 in the transport path and/or, in the case of multiple printing nips 11; 12, the printing couple or printing couples 06; 07 involved in the second or downstream printing nip 11 in the transport path is or are preferably embodied as based on an indirect printing method. Preferably, at least the at least one printing couple 08; 09 of an upstream or first printing nip 12 or each of the two printing couples 08, 09 cooperating as a blanket-to-blanket printing nip 12 are likewise embodied as based on an indirect printing method.

In the embodiment of the present invention as a printing press for processing sheet-format printing substrate 02, the printing substrate sheets 02 are preferably directed toward the sole or first printing nip 12; 11 by a transport system with successive sheet transfers between rotating transport means 33; 38; 39 involved in the transport, e.g. transport cylinders 33; 38; 39 and/or transport drums 33; 38; 39. The last transport means 33; 38; 39 in the transport direction transfers the printing substrate sheet 02 to a cylinder 17; 19; 19* of a printing couple 17; 19; 19*, e.g. to a printing couple cylinder 17; 19; 19* that acts as a transport cylinder 17; 19; 19*. The conveyor line 36 that leads from the feed device 01 to the printing couple cylinder 17; 19; 19* of the first printing nip 11; 12 in the transport path can comprise a transport means 46 embodied, for example, as a belt conveyor 46 or feed table 46, e.g. upstream of the at least one rotating transport means 33; 38; 39.

If multiple printing nips 11; 12 are provided, the printing substrate sheets 02 are also transported between these, preferably via a conveyor line 37 that involves successive sheet transfers between rotating transport means. On the output side of the last printing nip 11 to a subsequent unit and/or to the product delivery 04, this can likewise be accomplished via a system that involves transfers of sheets between cylinders and/or drums, via a transport system 13 that has a circulating tractive means, e.g. a chain gripper system 13 as shown in FIG. 1, for example, or via a transport system 13* that comprises, for example, one or more belt conveyors or feed tables, as shown by way of example in FIG. 8.

At least one drying device 14, in particular a radiation dryer 14, such as an IR or UV dryer, for example, is preferably provided on the transport path, preferably on both sides thereof, downstream of the last printing nip 11 and/or along the transport path to the product delivery 04. Said drying device acts, in particular, over at least the greatest printing width upstream, i.e. the maximum dimension, transversely to the transport direction, of the region printed upstream.

A printing couple 06; 07; 08; 09 configured for indirect printing comprises a cylinder 16; 17; 18; 19, e.g. printing couple cylinder 16; 17; 18; 19, configured as a transfer cylinder 16; 17; 18; 19, which forms a printing nip 11; 12 with a cylinder 16; 17; 18; 19; 19*, e.g. printing couple cylinder 16; 17; 18; 19; 19*, acting as an impression cylinder. In the case of a blanket-to-blanket printing nip 11; 12, the printing couple cylinder 16; 17; 18; 19 that acts as an impression cylinder 16; 17; 18; 19 is likewise formed by an ink-carrying printing couple cylinder 16; 17; 18; 19, in particular by the transfer cylinder 16; 17; 18; 19 of the printing couple 06; 07; 08; 09 that forms a blanket-to-blanket printing couple 06; 07; 08; 09 with the printing couple 06; 07; 08; 09 mentioned first. The transfer cylinder 17; 16; 18, 19 cooperates—upstream with respect to the flow of ink—with at least one image-producing cylinder 21; 22; 23; 24, e.g. printing couple cylinder 21; 22; 23; 24, e.g. at least one forme cylinder 21; 22; 23; 24, which is or can be inked with printing ink upstream by a suitable inking device 26; 27; 28; 29, e.g. an inking unit 26; 27; 28; 29.

Although the forme cylinder 21; 22; 23; 24 and the associated inking unit 26; 27; 28; 29 can generally be embodied as based on any desired printing method, they are preferably configured, as described above, for at least the first or sole printing couple 06; 07; 08; 09 in the transport path on one printing material side, as based on a planographic printing method, in particular indirect, e.g. as an offset printing couple that operates according to an offset printing method, and/or as based on a letterpress or relief printing method, in particular indirect, for example a letterset printing method, e.g. as a letterset printing couple that operates according to a letterpress printing method. For this purpose, in the embodiment mentioned first, the forme cylinder 21; 22; 23; 24 carries on its outer circumference a planographic printing forme (not shown here), e.g. an offset printing forme for wet or dry offset, which cooperates with an inking unit 26; 27; 28; 29 suitable for planographic printing, in the case of wet offset, e.g. a roller inking unit 26; 27; 28; 29 having an ink fountain upstream and having a dampening unit, and in the case of dry offset, e.g. having a short inking unit 26; 27; 28; 29 comprising an anilox or saucer roller and a doctor blade device, for example. For the embodiment for letterpress or relief printing, the forme cylinder 21; 22; 23; 24 carries on its outer circumference a letterpress printing forme (not shown here), which cooperates with an inking unit 26; 27; 28; 29 suitable for letterpress printing, e.g. a roller inking unit 26; 27; 28; 29 having an ink fountain upstream. In contrast to conventional flexographic or direct letterpress printing methods, the letterpress forme used in particular for printing with a background motif or a background color gradient is configured, e.g. with a protrusion of the raised printing area in relation to the non-printing lower-lying area of no more than 1 mm, for example, in particular no more than 0.5 mm. Such "waterless" printing couples with such letterpress formes, which are or can be operated in an indirect method, are also often referred to in particular as "offset printing couples", in particular waterless, due to the indirect printing method and the shallow relief depth.

In a particularly preferred embodiment, on at least one side of the transport path at least one of the printing couples 06; 07; 08; 09, e.g. the sole or first and/or the second in the transport path, is embodied as a collect printing couple 06; 07; 08; 09, i.e. for the simultaneous, in particular multicolor, printing of two print image segments. The printing couple 06; 07; 08; 09 configured as a collect printing couple 06; 07; 08; 09 comprises as a transfer cylinder 16; 17; 18; 19 an ink-carrying printing couple cylinder 16; 17; 18; 19 that acts as an ink-collecting cylinder 16; 17; 18; 19, which cooperates, upstream with respect to the flow of ink, with at least two image-producing printing couple cylinders 21; 22; 23; 24, e.g. at least two forme cylinders 21; 22; 23; 24, which are inked by respective inking devices 26; 27; 28; 29, e.g. inking units 26; 27; 28; 29. Said forme cylinders 21; 22; 23; 24 and associated inking units 26; 27; 28; 29 of a collect printing couple 06; 07; 08; 09 can all be embodied, as described above, as operating according to the planographic printing method, e.g. as wet offset printing couples, or as operating according to the letterpress printing method, e.g. as letterpress printing couples, or as operating partly according to the planographic printing method and partly according to the letterpress printing method. If an opposing printing couple 07; 06; 09; 08 is provided, said printing couple can also be configured as a collect printing couple 07; 06; 09; 08, as described, and can have a transfer cylinder 17; 16; 19; 18 that acts in the manner described above as an ink-collecting cylinder 17; 16; 19; 18.

Figure 4:
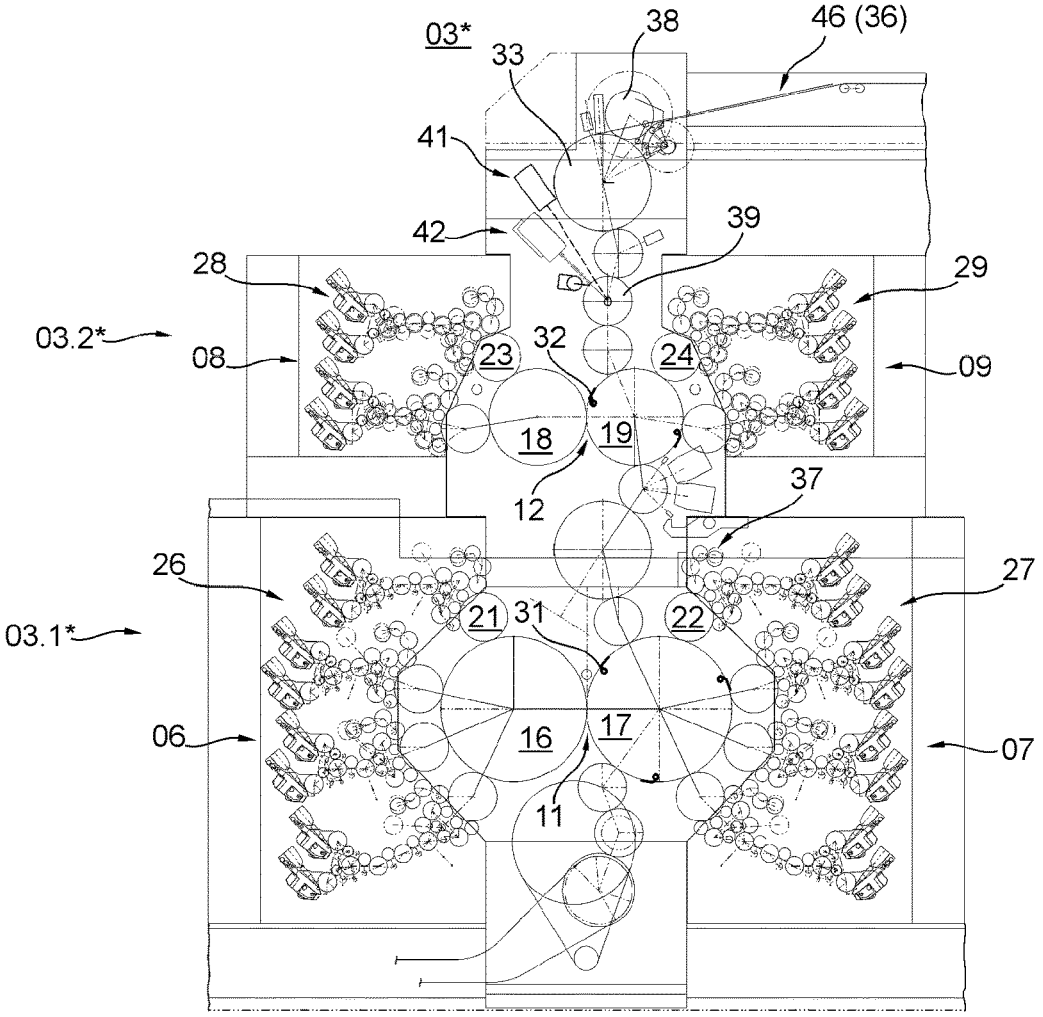
FIG. 4 an enlarged illustration of a printing group in a second embodiment alternative to the first embodiment.

In the case of a printing press that processes sheet-format printing substrate 02, one of the two printing couple cylinders 16; 17; 18; 19; 19* that form the printing nip 11; 12 is embodied as a transport cylinder 16; 17; 18; 19; 19* and acts as such, and preferably comprises on its outer circumference one or more holding devices 31; 32, known in particular as gripper strips 31; 32, only indicated in FIG. 2, FIG. 4 and FIG. 6.

As indicated above, the printing substrate 02, which in particular is as yet unprinted, is transported from the feed device 01 to the first printing nip 12; 11 in the printing substrate path of the printing press, in particular to the printing couple cylinder 17; 19; 19* thereof that acts as a transport cylinder 17; 19; 19*, via at least one rotating transport means 33; 38; 39, e.g. a transport cylinder 33; 38; 39 or what is known as a transport drum 33; 38; 39, which preferably comprises on its outer circumference at least one holding device 34, in particular what is known as a gripper bar 34, which is merely indicated in FIG. 3, FIG. 5 and FIG. 7. Transport along the last transport path section of the conveyor line 36 upstream of the first printing nip 12; 11 in the transport path is thus preferably based on a transport system involving successive sheet transfers between cylinders 19; 19*; 17 and/or transport means 33; 38; 39 that are involved in said transport.

On the transport path of the conveyor line 36 from the feed device 01 to the first printing nip 12; 11, at least one inspection device 41; 42 is provided for inspecting the printing substrate 02—as yet unprinted, in particular. In particular, at least one inspection device 41 configured as a transmissive inspection device 41 (also referred to as transmitted light inspection) and/or one inspection device 42 configured as a reflective inspection device 42 (also referred to as incident light inspection) is provided there.

The transmissive inspection device 41 preferably has at least one sensor 43, which is further preferably configured as an optical sensor 43 and/or as a sensor 43 for electromagnetic radiation, in particular as a camera 43, particularly preferably as a line camera 43, which scans an inspection line 47 that runs transversely to the direction of transport of the printing substrate 02. Said inspection line 47 extends in particular over at least 80% of the printing substrate width, preferably over at least the printing width, i.e. the maximum dimension of the area to be printed in the transverse direction, of the printing nip(s) 11; 12 following downstream. The inspection device 41 is therefore preferably a device for inspecting the printing substrate 02 over at least 80% of its width, preferably over at least the printing width to be printed downstream. The scanning is carried out, for example, in a scanning segment 54 having an opening angle $\alpha$ that measures between 45° and 75°, for example, in particular between 55° and 65°. In a refinement, the transmissive inspection device 41 has two such sensors 43, which can be configured to respectively detect different wavelength ranges, for example visible light, on one hand, and in particular infrared radiation (IR), on the other. The transmissive inspection device 41 also has at least one illumination means 44, which is preferably adapted, at least with respect to its wavelength, to the assigned sensor 43, and vice versa. The at least one sensor 43 of the transmissive inspection device 41 and the at least one illumination means 44 of the transmissive inspection device 41 are preferably arranged on different sides of the specific region of the transport path provided for the transport of printing substrate 02 toward which the at least one sensor 43 and/or the at least one illumination means 44 of said transmissive inspection device 41 is/are directed.

In a preferred embodiment (see, e.g., FIG. 1 to FIG. 12), the at least one sensor 43, for example, or preferably the at least one illumination means 44 of the transmissive inspection device 41 is arranged within a rotating transport means 33; 38; 39 of the conveyor line 36 and the corresponding other component consisting of sensor 43 and illumination means 44, e.g. the sensor 43, is arranged outside of this rotating transport means 33; 38; 39 and directed toward its surface. In other words, in a preferred embodiment, sensor 43 and illumination means 44 are arranged on different sides of the wall of the transport means. This rotating transport means 33; 38; 39 embodied, in particular, as a transport cylinder 33; 38; 39 then preferably has a circumferential surface or wall that is at least partially transparent in at least the wavelength range that is relevant for the inspection, in particular a cylinder body that is transparent over at least a circumferential length that corresponds to the printing length. The rotating transport cylinder 33; 38; 39 can be assigned at least one pressing element, in particular for positioning the printing substrate 02 flat on the circumferential surface of the transport cylinder 33; 38; 39.

In one suitable embodiment of the assembly, the transmissive inspection device 41 is intended to cooperate with the first transport means 33 downstream of the sheet feeder or the feed drum 38 thereof (e.g., in FIG. 2, FIG. 3, FIG. 6 and FIG. 7, for example). In another suitable embodiment, the transmissive inspection device 41 is intended to cooperate, e.g. with a transport means 39 that lies further downstream in the transport path (e.g. in FIG. 4, FIG. 5, FIG. 9 and FIG. 10, for example).

The illumination means 44 and the sensor 43 embodied as a line camera 43 are preferably arranged in such a way that the illumination means 44 irradiates the at least partially transparent transport cylinder 33; 38; 39, in particular from the inside, along an inspection line 47 that extends axially on the cylinder shell and that intersects the connecting line that extends radially between the center of the camera lens and the cylinder axis. The illumination means 44 preferably lies on this connecting line. Thus, the inspection line 47 to be detected on the outside of the printing substrate is produced by irradiation with the illumination means 44, configured, for example, as an infrared illumination means, along a line extending from the central axis of the transport cylinder 33; 38; 39 to the center of the camera lens through the cylinder shell, which is transparent in at least the relevant wavelength range, and through the substrate. The illumination means 44 is preferably embodied with illuminants in the form of LED's, in particular with illuminants in the form of IR LED's.

In a preferred embodiment, the transport cylinder 33; 38; 39 that cooperates with the transmissive inspection device 41 is advantageously made of a transparent plastic, in particular thermoplastic, and is preferably made of polymethyl methacrylate (PMMA) or acrylic glass. The cylinder shell body is composed of two parts, for example, e.g. with two drum caps, and/or is coated with an additional scratch-resistant coating and/or is made of an IR-permeable and/or UV-resistant material, in particular the aforementioned plastic.

In a second embodiment (see, e.g. FIG. 14 and FIG. 15, by way of example), which can likewise be applied to all exemplary embodiments of the printing press and/or printing group 03; 03*; 03; 03***, the at least one transmissive inspection device 41 is provided within the feed device 01 or in particular along the transport path of a transport means 46 that conveys the printing substrate sheets 02 linearly in at least one section, e.g. a feed table 46 or belt conveyor 46. In that case, sensor 43 and illumination means 44 are arranged on the two sides of the transport path in a transport path section which, in one variant of said embodiment, may be, e.g. a transport path section of the transport path that is to be traversed by the printing substrate 02 during normal operation (see, e.g. FIG. 14) and in another variant of said embodiment may be a transport bypass 48 that runs parallel to the transport path to be traversed during normal operation (see, e.g. FIG. 15). The latter can be selected and/or activated, e.g. via an actuating means 49**, e.g. a sheet diverter or a transfer roller, in order to inspect one or more sample sheets, for example.

The illumination means 44 of the transmissive inspection device 41 preferably emits light at least predominantly in an IR wavelength range, i.e. with a maximum radiation greater than 780 nm. It preferably emits the electromagnetic radiation in a narrow band, i.e. with a spectral half-width of at most 150 nm, preferably at most 100 nm based on radiant power. The radiation maximum is preferably at a wavelength of 850±75 nm, in particular 850±50 nm. Accordingly, the sensor 43, which is preferably configured as a camera 43, in particular a line camera 43, is embodied as an IR-sensitive camera 43, in particular a line camera 43.

The reflective inspection device 42, which is provided in place of or preferably in addition to the transmissive inspection device 41, preferably has at least one sensor 51, more preferably configured as an optical sensor 51 and/or as a sensor 51 for electromagnetic radiation, in particular as a camera 51, particularly preferably as a line camera 51, which scans an inspection line 53 that runs transversely to the direction of transport of the printing substrate 02. Said inspection line 53 extends in particular over at least 80% of the printing substrate width, preferably over at least the printing width, i.e. the maximum dimension of the region to be printed in the transverse direction, of the downstream printing nip(s) 11; 12. The inspection device 42 is therefore preferably a device for inspecting the printing substrate 02 over at least 80% of its width, preferably over at least the printing width to be printed downstream. In a refinement, the reflective inspection device 42 has two such sensors 51, which can be configured to respectively detect different wavelength ranges, for example visible light, on one hand, and in particular ultraviolet radiation (UV), on the other. The reflective inspection device 42 has at least one illumination means 52, which is preferably adapted, at least with respect to its wavelength, to the assigned sensor 51. The at least one sensor 51 of the reflective inspection device 42 and the at least one illumination means 52 of the reflective inspection device 42 are arranged on the same side of the printing substrate 02 on the transport path. Said illumination means 52 is directed toward an inspection line 53, which is scanned by the sensor 51, preferably configured as a line camera 51.

For this purpose, in a first embodiment (see, e.g. FIG. 1 to FIG. 11 and FIG. 13), for example, the at least one illumination means 52 of the reflective inspection device 42 is arranged directed toward the circumferential surface of a rotating transport means 33; 38; 39 in the transport path, and the sensor 51 is arranged directed toward the same point on said rotating transport means 33; 38; 39. The rotating transport cylinder 33; 38; 39 can be assigned at least one pressing element, in particular for positioning the printing substrate 02 flat on the circumferential surface of the transport cylinder 33; 38; 39.

In this first embodiment, the illumination means 52 and the sensor 51, embodied as a line camera 51, are preferably arranged in such a way that the camera lens is directed toward the central axis of the transport cylinder 33; 38; 39 and/or the illumination means 52 irradiates the transport cylinder 33; 38; 39 from the outside to produce the inspection line 53, at an angle that deviates no more than 30°, preferably no more than 20°, from the radial direction of the transport cylinder 33; 38; 39 at the location of the inspection line. However, illumination means 44 lies outside of the direct line of sight between camera 52 and inspection line 53.

In an advantageous variant of an embodiment that has both a transmissive inspection device 41 provided on a transport cylinder 33, 38; 39 and a reflective inspection device 42 provided on a transport cylinder 33; 38; 39, both inspection devices 41; 42 are provided on the same transport cylinder 33; 38; 39. In this variant, however, the respective illumination means 44; 52 and sensors 43; 51 are preferably arranged in such a way that the inspection lines 47; 53 to be evaluated on the cylinder circumference do not coincide, but are spaced apart from one another in the circumferential direction, for example by at least 30 mm, preferably by at least 50 mm.

In another embodiment (not explicitly illustrated) specifically for presses that have a "horizontal transport path" as described below, for example, the transmissive inspection device 41 and the reflective inspection device 42 can also cooperate with different transport cylinders 33; 38; 39.

For all embodiments, a second reflective inspection device 42 can also be provided, which cooperates with a transport cylinder 33; 38; 39 other than the transport cylinder 33; 38; 39 that cooperates with the first reflective inspection device 42 and supports the printing substrate sheet 02 on the other side of the printing substrate.

In the embodiments according to FIG. 1 to FIG. 7, the transmissive inspection device 41 and/or the reflective inspection device 42 cooperates, e.g. with a transport cylinder 33; 39 that is the penultimate transport cylinder 33; 39 upstream of the printing couple cylinder 17; 19; 19* that acts as a transport cylinder 17; 19; 19* in the transport path.

In an advantageous embodiment, the transport cylinder 33; 38; 39 that cooperates with the transmissive inspection device 41 and/or the reflective inspection device 42 is embodied as double-sized, i.e. having a circumference sufficient to accommodate two printing substrate sheets 02 and/or having two holding devices, in particular gripper bars, in particular diametrically opposite one another in the circumferential direction. In that case, there is less curvature in the measuring region than with a single-sized cylinder and/or more installation space is available in the interior for the illumination means 44.

In the embodiment of FIG. 4 and FIG. 5, this transport cylinder 33; 38; 39 can likewise be configured as double-sized or the transmissive inspection device 41 and/or the reflective inspection device 42 for this exemplary embodiment can also be provided on the second transport cylinder 33 lying in the transport path, i.e. the transport cylinder configured, e.g., as double-sized and following the transport means 38 configured as a feed drum 38 (see FIG. 4 and FIG. 5).

Figure 14:
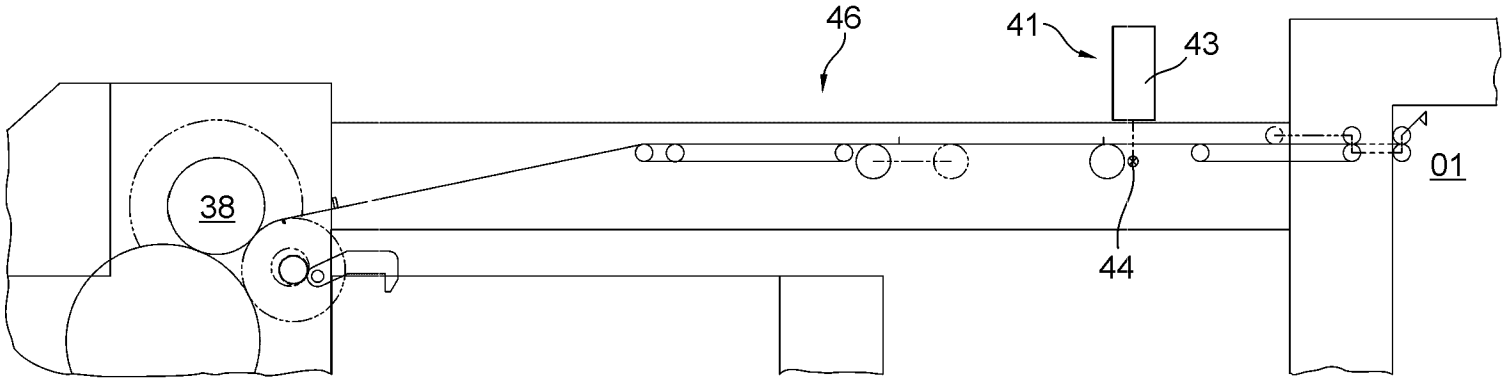
FIG. 14 a section of the conveyor line located upstream of the first printing nip with an alternative arrangement of the transmissive inspection device.
Figure 15:
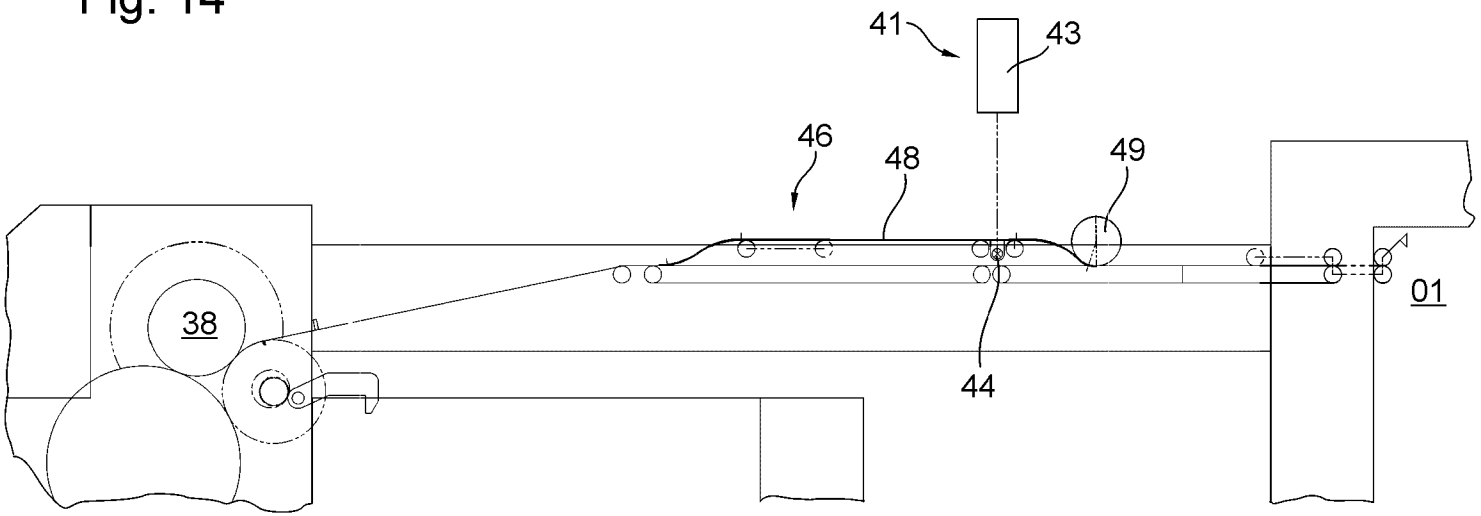
FIG. 15 a section of the conveyor line located upstream of the first printing nip with a variant of the alternative arrangement from FIG. 14.

In a second embodiment shown in FIG. 14 and FIG. 15 but not explicitly, which can likewise be applied to all the exemplary embodiments of the printing press and/or printing groups 03; 03*; 03; 03***, the at least one reflective inspection device 42 is still within the feed device 01 or in particular on the transport path of a transport means 46 that conveys the printing substrate sheets 02 linearly in at least one section, e.g. a feed belt 46 or belt conveyor 46. In said embodiment, sensor 51 and illumination means 52 are arranged on the two sides of the transport path in a transport path section that in one embodiment variant may be provided by a transport path section of the transport path to be traversed by the printing substrate 02 during normal operation, for example, and in another embodiment variant may be provided by a transport bypass 48 that runs parallel to the transport path to be traversed during normal operation. The latter can be selected and/or activated, e.g. via an actuating means 49**, e.g. a sheet diverter or a transfer roller, in order to inspect one or more sample sheets, for example.

The illumination means 52 of the reflective inspection device 42 preferably emits light at least predominantly in a UV wavelength range, i.e. with a maximum radiation of less than 380 nm. It preferably emits the electromagnetic radiation in a narrow band, i.e. with a spectral half-width of at most 150 nm, preferably at most 100 nm based on radiant power. Preferably, the radiation maximum is at a wavelength of 365±75 nm, in particular 365±50 nm. Accordingly, the sensor 51, which is preferably configured as a camera 51, in particular a line camera 51, is embodied as a UV-sensitive camera 51, in particular a line camera 51. The illumination means 52 is preferably embodied with illuminants in the form of LED's, in particular with illuminants in the form of UV LED's.

In a preferred embodiment, the reflective inspection device 42 is protected against a direct line of sight into the UV light source of the illumination means 52 and/or against the incidence of UV scattered light in the region of the inspection line 53 and is equipped with appropriate protective means.

Generally regardless of which embodiment of illuminant is provided in the illumination means 44; 52, but preferably at least in the case of an embodiment that has one or more IR or UV illuminants configured as lamps, the illumination means 44; 52 is associated with a cooling means. Said cooling means is preferably in the form of a line for conducting cooling fluid, which can supply the cooling fluid, e.g. via a first connection 56; 58 and can remove it via another connection 57; 59 (see, e.g. FIG. 11, FIG. 12 or FIG. 13).

Figure 11:
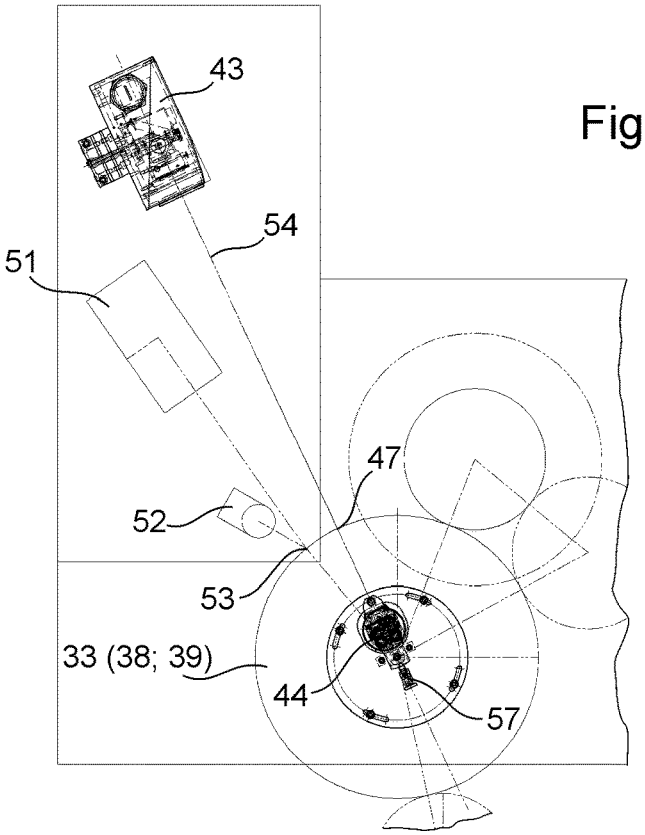
FIG. 11 an enlarged side view depicting the positioning of the inspection device(s) for the embodiments of FIG. 3, FIG. 5, FIG. 7 and FIG. 10.
Figure 12:
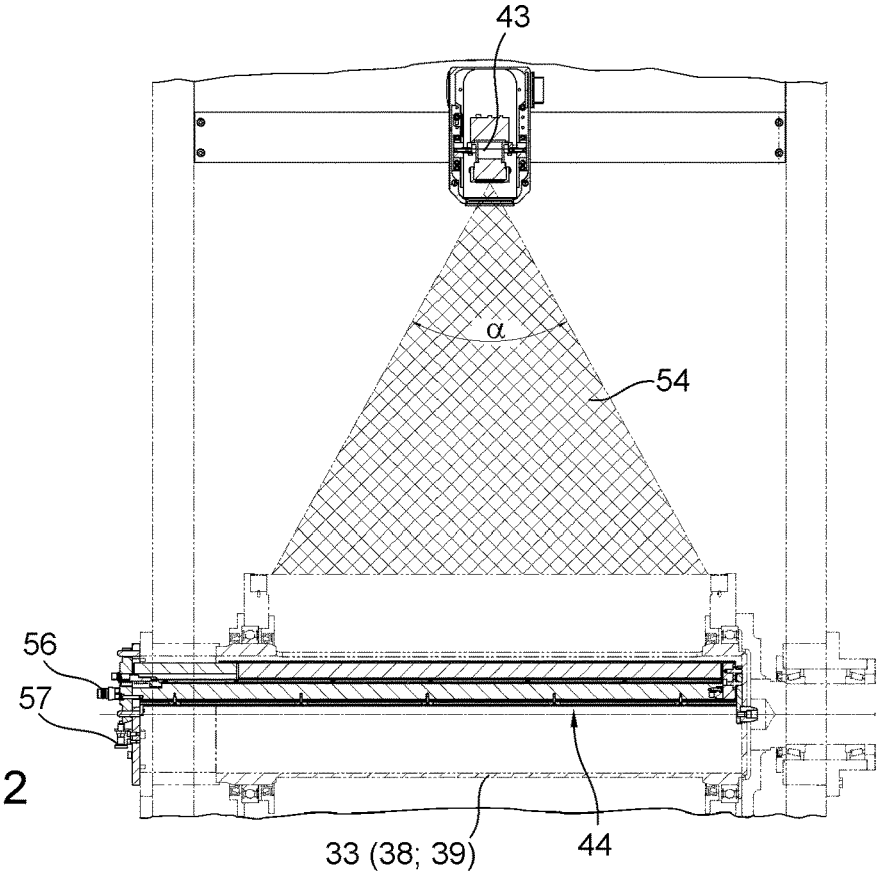
FIG. 12 a sectional view of an inspection device embodied as a transmissive inspection device.
Figure 13:
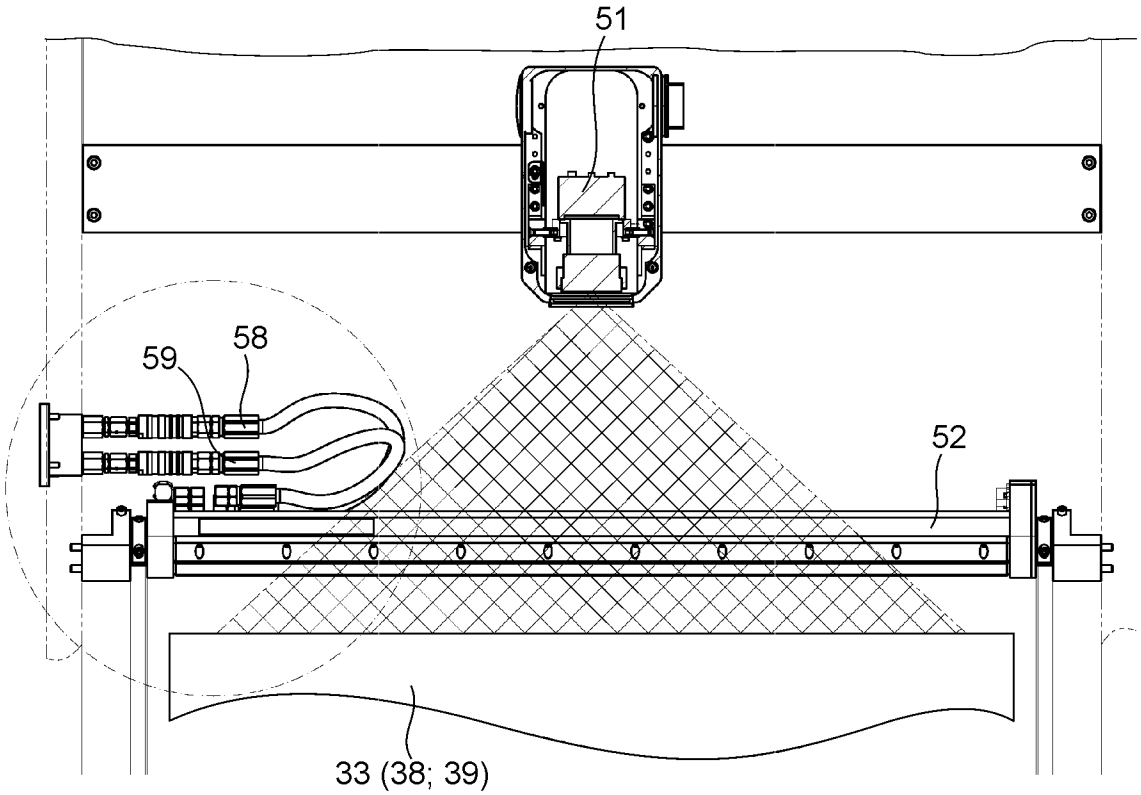
FIG. 13 a sectional view of an inspection device embodied as a reflective inspection device.

In the embodiment that includes a transmissive inspection device 41 and a reflective inspection device 42, the inspection system thus comprises two systems, each of which comprises a camera 43; 51, and each of which scans an inspection line 47; 53 on a transport cylinder 33; 38; 39 or transport means 46, which is embodied as transparent at least partially and/or within a wavelength window, transversely to the transport direction, each inspection line 47; 53 being irradiated by a uniquely dedicated illumination means 44; 52 (e.g. with UV radiation, on one hand, and with IR radiation, on the other). In FIG. 11 to FIG. 13, this circumstance is illustrated on the transport cylinder 33, by way of example, however it also applies to the other transport cylinders 38 and/or to transport cylinders 33; 38; 38 of a different circumference (indicated in the figures in question by the reference numerals 38 and 39 shown in parentheses).

In the illustrated and preferred embodiments, the sole or at least one of the printing nips 11; 12, e.g. at least the downstream printing nip 11, comprises two cooperating collect printing couples 06; 07, each having at least two, e.g. two or four, forme cylinders 21; 22 and associated inking units 26; 27 (e.g., FIG. 2, FIG. 4, FIG. 6 and FIG. 8).

The printing couple cylinders 16; 17; 18; 19; 19* that form the sole or downstream printing nip 11; 12 of a printing nip group 03; 03*; 03 that has a vertical product path, for example, are preferably embodied as triple-sized here, i.e. sufficient to accommodate three printing substrate sheets 02 on their circumference, while those cylinders that form a first of multiple printing nips 11; 12 and/or that form a printing nip group 03*** that has a horizontal product path, for example, are preferably embodied as double-sized, i.e. sufficient to accommodate two printing substrate sheets 02** on their circumference.

If the first or sole printing nip 11; 12 in the printing substrate path is provided with a conveyor line 36 having multiple rotating transport means 33; 38; 39, in particular transport drums 33; 38; 39, between the feed device 01 and the transport cylinder 19* of the first or sole printing nip 12 in the transport path, the transmissive inspection device 41 and/or the reflective inspection device 42 can generally be provided on the transport path of any of the rotating transport means 33; 38; 39. However, at least the transmissive inspection device 41 is preferably provided on a transport means 33 that is situated downstream of a first rotating transport means 38 that receives the printing substrate sheets 02 from a preceding transport means 46, e.g. a belt conveyor 46 or feed table 46, or directly from the feed device 01, and/or that is situated upstream of a rotating transport means that is positioned as the last rotating transport means upstream of the printing couple cylinder 17; 19; 19* for receiving the printing substrate sheets 02 of the first printing nip 12; 11 in the printing substrate path. The or a reflective inspection device 42 is preferably provided on a transport means 33; 38; 39 on which the printing substrate sheet 02 is conveyed resting on the same printing substrate side on which it is conveyed, resting on the printing couple cylinder 17; 19; 19* that acts as transport cylinder 17; 19; 19*, through the first or sole printing nip 12; 11 in the transport path.

As indicated by way of example by dashed lines in FIG. 9 and FIG. 10 in the embodiment having a horizontal printing substrate path, the transmissive inspection device 41 and the reflective inspection device 42 could in principle also be arranged on the printing substrate path so as to cooperate with different transport cylinders 33; 38; 39.

In the production of a security product or security intermediate product in an aforementioned printing press, in which an as yet unprinted printing substrate 02 is printed initially in a first printing process, the at least one inspection device 41; 42 carries out a pre-inspection. The purpose of this is to check for security features that are already contained in or on the printing substrate 02 prior to the first of multiple printing processes, for example, i.e. prior to the initial printing of the as yet unprinted substrate 02.

During the pre-inspection, one or more of the following inspections are carried out: A security thread, e.g. embedded in the printing substrate sheet 02, is inspected, in particular by inspecting the entire sheet 02.

For example, in the transmitted light method, in particular with the application of IR radiation and using, e.g. an aforementioned transmissive inspection device 41, a check for the presence/absence of a security thread and/or a check for continuity, i.e. absence of interruption, of the security threads in the printing substrate 02 and/or a check for variations in the thickness of the security thread and/or for a lateral migration of the security thread beyond a specified limit and/or a check of a microtext contained in or on the security thread may be carried out.

In addition to or in place of this, e.g. in the incident light method, in particular with the application of UV radiation and using an aforementioned reflective inspection device 42, a check for the presence/absence of UV fluorescence in the security thread and/or a check for the presence/absence of a watermark over the entire sheet 02 and/or a check for the presence or absence of possibly included security fibers and/or UV fluorescence in the fibers over the entire sheet 02 may be carried out.

On the output side, the inspection devices 41; 42 are connected in terms of signals, for example via a data processing device, to a press controller, by means of which, when a printing substrate sheet 02 is identified as defective, the dropping of this printing substrate sheet 02 above a pile space specified as a scrap pile in the pile delivery 04 is or can be triggered based on an inspection result that represents the quality of the inspected printing substrate sheet 02 in the pile delivery 04. As a further consequence of the inspection result for a sheet of printing substrate 02 that has been identified as defective, the press controller can also shut down or effect a shutdown of the or a printing nip 11; 12; 12*. Printing substrate sheets 02 that are recognized as being free of defects are or can be delivered as good sheets onto a product pile in a pile space of the pile delivery 04.

While preferred embodiments of a printing press and method for producing security products or security intermediate products, in accordance with the present invention, have been set forth fully and completely hereinabove, it will be apparent to one of skill in the art that various changes could be made thereto, without departing from the true spirit and scope of the present invention, which is accordingly to be limited only by the appended claims.

The invention claimed is:

1. A printing press for producing ones of security products and security intermediate products, comprising:

a feed device for feeding as yet unprinted printing substrate along a printing substrate path into the printing press;

a plurality of printing couples in the printing substrate path by which plurality of printing couples the unprinted printing substrate can be printed on both sides in a multicolor process in one of an indirect planographic printing method and an indirect letterpress printing method in at least one printing nip;

wherein, in a conveyor line between the feed device and a first printing nip in the printing substrate path, a reflective inspection device having a first camera is provided on a transport path of a transport cylinder in the conveyor line between the feed device and the first printing nip, which reflective inspection device uses UV radiation for inspecting the as yet unprinted printing substrate for security features contained one of in and on the printing substrate;

wherein, in the conveyor line between the feed device and the first printing nip in the printing substrate path, a transmissive inspection device is additionally provided; and wherein the transmissive inspection device comprises an IR-sensitive camera as a second camera and is provided on the transport path of the transport cylinder, a circumferential surface of which transport cylinder is at least partially transparent in at least a wavelength range that is relevant for an inspection of the as yet unprinted printing substrate by the transmissive inspection device.

2. The printing press according to claim 1, one of wherein the reflective inspection device comprises an illumination means and the first camera and wherein the reflective inspection device comprises an illumination device that emits light with one of a radiation maximum lying in the UV wavelength range and with a spectral half-width of no more than 150 nm based on radiant power, and comprises a UV sensitive camera.

3. The printing press according to claim 2, one of wherein the illumination means and the first camera are arranged such that a camera lens of the first camera is directed toward a central axis of the transport cylinder and wherein, to form an inspection lined, the illumination means irradiates the transport cylinder from outside of the transport cylinder at an angle that deviates no more than 30° from a radial direction of the transport cylinder at a location of the inspection lined.

4. The printing press according to claim 2, wherein an illumination device of the transmissive inspection device is arranged in the transport cylinder in one of such a way that it irradiates the at least partially transparent transport cylinder from inside of the at least partially transparent transport cylinder along an inspection line that extends axially on a cylinder shell of the transport cylinder, which inspection line intersects a connecting line that extends radially between a center of a lens of the second camera and a cylinder axis of the cylinder shell, and in such a way that the illumination device lies on the connecting line between the center of a camera lens of the second camera and the cylinder axis.

5. The printing press according to claim 1, wherein an illumination device, of the transmissive inspection device is arranged inside the transport cylinder, and the second camera, is arranged outside of the transport cylinder and is directed toward a surface of the transport cylinder.

6. The printing press according to claim 1, wherein the transmissive inspection device comprises an illumination device that emits light one of with a maximum radiation lying in the IR wavelength range and with a spectral half-width of no more than 150 nm based on radiant power.

7. The printing press according to claim 1, wherein the transport path extends one of vertically through the at least one printing nip and between two printing nips.

8. The printing press according to claim 1, one of wherein, in the printing substrate path, the at least one printing nip is provided, which at least one printing nip has a printing couple embodied as a collect printing couple on one of at least one side of the printing substrate path and on both sides of the printing substrate path, and wherein, in the printing substrate path downstream of the transmissive inspection device, two printing nips configured as blanket-to-blanket printing nips are provided, spaced apart in relation to one another, each of which is formed by two printing couples, configured as collect printing couples, provided on the two sides of the printing substrate path.

9. The printing press according to claim 1, wherein one of the reflective inspection device and the transmissive inspection device is configured to inspect the as yet unprinted printing substrate over one of at least 80% of a width of the unprinted printed substrate running transversely to the direction of transport and over at least a printing width of the printing nip that follows downstream.

10. A method for producing ones of security products and security intermediate products, including;

feeding an as yet unprinted printing substrate into an input side of a security printing press;

printing the printing substrate on one of one and both sides of the printing substrate in one of an indirect planographic printing and a letterpress printing method in a printing nip lying in a printing substrate path;

inspecting the as yet unprinted printing substrate, before it reaches the printing nip by using a reflective inspection device having a first camera and using UV radiation for security features contained one of in and on the printing substrate;

locating the reflective inspection device on a transport path of a transport cylinder in the printing substrate path before the printing substrate reaches the printing nip; and additionally inspecting the as yet unprinted printing substrate, before the as yet unprinted printing substrate reaches the printing nip in a transmitted light method using at least one inspection device, embodied as a transmissive inspection device, having an IR sensitive camera provided as a second camera, and located on the transport path of the transport cylinder, for security features that are already contained in the as yet unprinted printing substrate.

11. The method according to claim 10, further including printing the printing substrate downstream of the transmissive inspection device in at least one printing nip one of on both sides simultaneously and with print images from multiple forme cylinders simultaneously according to a collect printing method.

12. The method according to claim 10, further including one of that, in the transmitted light method, a security thread embedded in the yet to be printed printing substrate is inspected, wherein one of a check for the presence and absence of a security thread is carried out and a check for continuity, such as one of an absence and an interruption, of the security threads in the printing substrate and a check for variations in a thickness of the security thread and a lateral migration of the security thread beyond a specified limit and an examination of a microtext contained one of in and on the security thread is carried out, and in that, in an incident light method, a check for one of the presence and absence of UV fluorescence in the security thread and a check for one of the presence and absence of a watermark and a check for one of the presence and absence of embedded security fibers and a UV fluorescence in the embedded security fibers is carried out.

13. The method according to claim 12, further including in that the inspection by the transmitted light method and the inspection by the incident light method are carried out during a transport of the yet to be printed printing substrate over a transport cylinder of a conveyor line located upstream of the printing nip in the printing substrate path.

* * * * *